US007337826B2

(12) United States Patent
Mautino et al.

(10) Patent No.: US 7,337,826 B2
(45) Date of Patent: Mar. 4, 2008

(54) RAILWAY CAR COUPLER KNUCKLE HAVING IMPROVED BEARING SURFACE

(75) Inventors: Peter S. Mautino, Pittsburgh, PA (US); Joseph L. Gagliardino, Oakdale, PA (US)

(73) Assignee: McConway & Torley, LLC, Pittsburgh, PA (US)

( * ) Notice: Subject to any disclaimer, the term of this patent is extended or adjusted under 35 U.S.C. 154(b) by 9 days.

(21) Appl. No.: 11/331,723

(22) Filed: Jan. 13, 2006

(65) Prior Publication Data

US 2006/0113267 A1 Jun. 1, 2006

Related U.S. Application Data

(60) Division of application No. 10/913,017, filed on Aug. 6, 2004, which is a continuation-in-part of application No. 10/041,875, filed on Jan. 7, 2002.

(51) Int. Cl.
*B22D 33/04* (2006.01)

(52) U.S. Cl. ..... 164/137; 164/368; 213/75 R

(58) Field of Classification Search ..... 164/137, 164/368; 213/75 R
See application file for complete search history.

(56) References Cited

U.S. PATENT DOCUMENTS

| | | | | |
|---|---|---|---|---|
| 2,585,958 A | | 2/1952 | Metzger | |
| 2,688,412 A | * | 9/1954 | Kulieke | 213/155 |
| 3,670,901 A | | 6/1972 | Metzger | 213/151 |
| 3,722,708 A | | 3/1973 | Ion et al. | 213/151 |
| 3,779,397 A | | 12/1973 | De Penti | 213/151 |
| 3,856,156 A | | 12/1974 | Metzger | 213/151 |
| 3,857,495 A | | 12/1974 | Kaufhold | 213/151 |
| 3,872,978 A | | 3/1975 | Altherr | 213/151 |
| 4,024,958 A | | 5/1977 | Kaufhold | 213/152 |
| 4,090,615 A | | 5/1978 | Martin | 213/151 |
| 4,143,701 A | | 3/1979 | Oshinsky et al. | 164/368 |
| 4,206,849 A | | 6/1980 | Kaim | 213/151 |
| 4,605,133 A | | 8/1986 | Altherr | 213/155 |
| 4,645,085 A | * | 2/1987 | Hanula et al. | 213/155 |
| 4,811,854 A | | 3/1989 | Elliott | 213/155 |
| 5,050,751 A | | 9/1991 | Thrift et al. | 213/111 |
| 5,582,307 A | * | 12/1996 | Hawthorne et al. | 213/109 |
| 5,954,212 A | | 9/1999 | Beatty et al. | 213/155 |
| 6,129,227 A | | 10/2000 | Openchowski et al. | 213/111 |
| 2003/0127412 A1 | | 7/2003 | Mautino et al. | 213/75 R |

FOREIGN PATENT DOCUMENTS

| | | |
|---|---|---|
| GB | 19963 | 9/1914 |
| GB | 708196 | 4/1954 |

OTHER PUBLICATIONS

Notification Concerning Transmittal of Copy of International Preliminary Report on Patentability; International Patent Application PCT/US2005/027168 (8 pages).

* cited by examiner

*Primary Examiner*—Jonathan Johnson
*Assistant Examiner*—I.-H. Lin
(74) *Attorney, Agent, or Firm*—Baker Botts L.L.P.

(57) ABSTRACT

Knuckle coupler castings and methods for casting the knuckle coupler castings, where the knuckle coupler castings having enhanced bearing surfaces which may include a vertically flat surface.

11 Claims, 10 Drawing Sheets

RAILWAY CAR COUPLER KNUCKLE HAVING IMPROVED BEARING SURFACE

RELATED APPLICATIONS

This application is a divisional of U.S. patent application Ser. No. 10/913,017 entitled, Railway Car Coupler Knuckle Having Improved Bearing Surface, filed Aug. 6, 2004, which is a Continuation-in-Part of U.S. patent application Ser. No. 10/041,875 entitled, Railway Car Coupler Knuckle Having Improved Bearing Surface, filed Jan. 7, 2002.

TECHNICAL FIELD OF THE INVENTION

The apparatus and methods described herein relate to railway freight car couplers which are disposed on each end of a railway freight car and, more particularly, to a railway freight car coupler knuckle having an improved bearing surface area for mating engagement with an adjacently disposed coupler knuckle disposed at one end of an adjacent railway freight car. Additionally, the apparatus and methods described herein relate to a railway freight car coupler knuckle having a bearing surface area and a lock wall cast using a common core.

BACKGROUND OF THE INVENTION

As is generally well known in the railway art, a coupler is disposed at each end of a railway car to enable joining one end of such railway car to an adjacently disposed end of another railway car. The engageable portions of each of these couplers is known in the railway art as a knuckle. For example, railway freight car coupler knuckles are taught in the following U.S. Pat. Nos. 4,024,958; 4,206,849; 4,605,133; and 5,582,307. The disclosure of each of these patents are incorporated herein by reference.

Knuckle failure accounts for about 100,000 train separations a year, or about 275 separations per day. Most of these separations occur when the train is out of a maintenance area and a replacement knuckle, which can weigh about 80 pounds, must be carried from the locomotive at least some of the length of the train, which may be up to 25, 50 or even 100 railroad cars in length. The repair of a failed coupler knuckle is labor intensive, sometimes in very inclement weather, and can cause train delays.

Over the years it has been discovered, in the railroad industry, that relatively small point to point contact surfaces of the engaged portions of these knuckles can cause premature failure due to stress points being established within the knuckle. These coupler knuckles are generally manufactured from a cast steel and during the casting process itself the interrelationship of the mold and cores disposed within the mold are critical to producing a satisfactory railway freight car coupler knuckle. For example, if, during such casting process, the mold should happen to slip along the parting line for any reason then a detrimental point to point surface contact can be established in the finished knuckle.

It has generally been difficult to manufacture coupler knuckle castings lacking the geometry that results in the point to point contact surface engagement with other knuckles. One reason for this is the draft angles which are generally required in order to produce a satisfactory casting. Typically, a mold cavity is made using a pattern. The pattern has slight draft angles, often between about 2° and about 3°, in order to allow the pattern to be withdrawn from the mold cavity. Without the draft angles, the withdrawal of the pattern from the mold cavity can result in the sidewalls defining a perimeter boundary of the mold cavity partially collapsing or otherwise deforming.

One solution used in an attempt to provide a satisfactory surface involves either grinding or machining the contact or bearing surfaces of the knuckle. However, grinding and/or machining of such surface can add substantially the to of cost producing a satisfactory coupler. Moreover, grinding the bearing surfaces can also establish point to point contact in a number of other places, and, as discussed above, this can add stress to the coupler knuckle and result in premature and unpredictable knuckle failure.

SUMMARY OF THE INVENTION

The present apparatus and methods provide a coupler knuckle casting having an enhanced bearing surface area. The coupler knuckle casting is utilized in a railway freight car coupler. The enhanced bearing surface area of the coupler knuckle casting may include a substantially flat portion disposed substantially in a vertical direction and which may be substantially arcuate in a horizontal direction. The substantially flat portion may extend for a predetermined distance in the vertical direction and for a predetermined length along the horizontal direction.

The substantially vertically flat surface may be formed during the casting process by a core positioned within a mold cavity. The core has a corresponding vertically flat surface that lacks the significant tapers inherent in pattern-formed sand mold cavities, and thus can provide a perimeter boundary within the mold cavity for forming the substantially vertically flat surface of the coupler knuckle casting.

A common core may be used to form the bearing surface and a lock wall, regardless of whether the bearing surface is an enhanced bearing surface. The use of a common core to form both the bearing surface and the lock wall minimizes undesirable discrepancies between the relative positioning of the bearing surface and the lock wall.

The enhanced bearing surface may extend along portions of a pulling face section, nose section, throat section and/or inner side section of the coupler knuckle casting. Preferably, although not necessarily, the enhanced bearing surface is positioned in regions of the pulling face section, nose section, throat section and/or inner side section that are in engagement with like regions of another knuckle when engaged with the other knuckle and subject to bearing forces, such as draft forces.

The coupler knuckle casting having the enhanced bearing surface area may be provided in combination with a railway freight car coupler. The improved coupler knuckle casting having the enhanced bearing surface area may be retrofitted with an existing railway freight car.

In one aspect, a knuckle for a railway freight car coupler is provided having an improved bearing surface which does not require any significant grinding and/or machining of the bearing surface when compared to prior art coupler knuckles. In another aspect, a knuckle for a railway freight car coupler having an improved bearing surface is provided which can exhibit an extended life cycle when compared to prior art type coupler knuckles. In still another aspect, a knuckle for a railway freight car coupler is provided having an improved bearing surface which can be retrofitted onto existing freight car couplers. In yet another aspect, a knuckle for a railway freight car coupler is provided having an improved bearing surface which can substantially minimize any point to point contact areas thereby minimizing stresses set up in the coupler knuckle which could cause premature failure of such coupler knuckle. In a further aspect, a knuckle for a railway freight car coupler is provided having an improved bearing surface which will substantially minimize coupler knuckle maintenance when compared to prior art type coupler knuckles. In an additional aspect, a knuckle for a railway freight car coupler is provided having an improved bearing surface which can be formed as a conventional steel or other alloy castings.

DETAILED DESCRIPTION OF THE INVENTION

Knuckle coupler castings and methods of casting knuckle coupler castings are described herein and illustrated in FIGS. 1-17. The knuckle coupler castings have enhanced bearing surfaces and/or enhanced lock wall surfaces. The enhanced bearing surfaces can reduce instances of point to point contact between engaged knuckles, and can result in knuckles having reduced failure rates and greater life span predictability. Moreover, a single core can be used to form the bearing and lock wall surfaces to provide improved relative positioning between the two surfaces.

Figure 1:
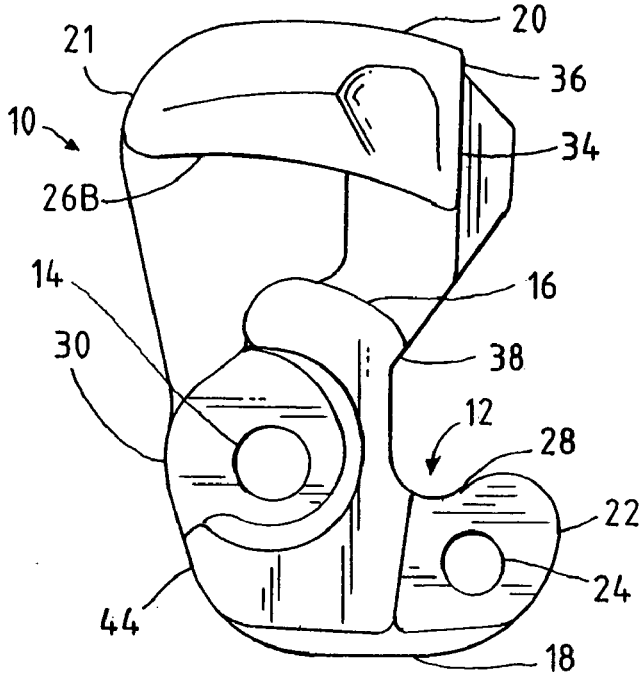
FIG. 1 is a top plan view of a railway car coupler knuckle.
Figure 2:
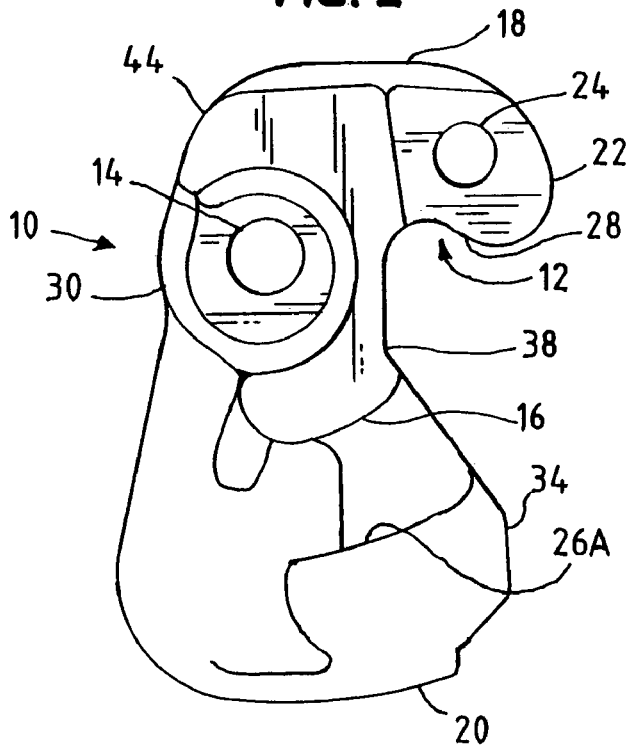
FIG. 2 is a bottom plan view of the railway car coupler knuckle of FIG. 1.
Figure 5:
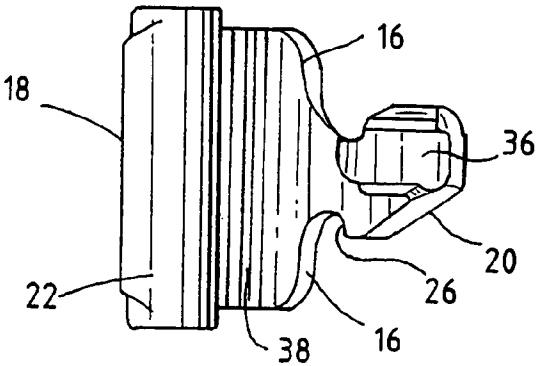
FIG. 5 is another side elevation view of the railway car coupler knuckle of FIG. 1.
Figure 4:
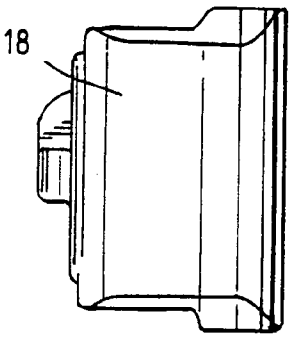
FIG. 4 is a front elevation view of the railway car coupler knuckle of FIG. 1.
Figure 3:
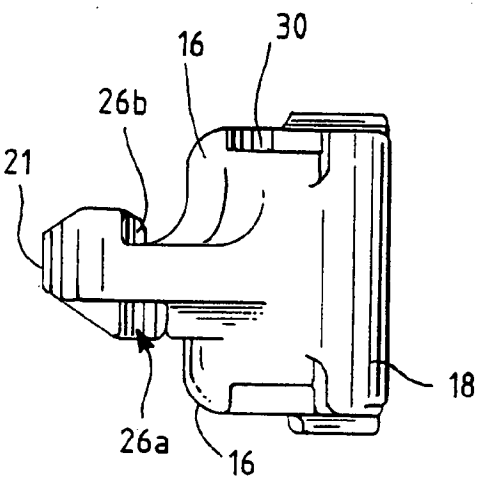
FIG. 3 is a side elevation view of the railway car coupler knuckle of FIG. 1.
Figure 6:
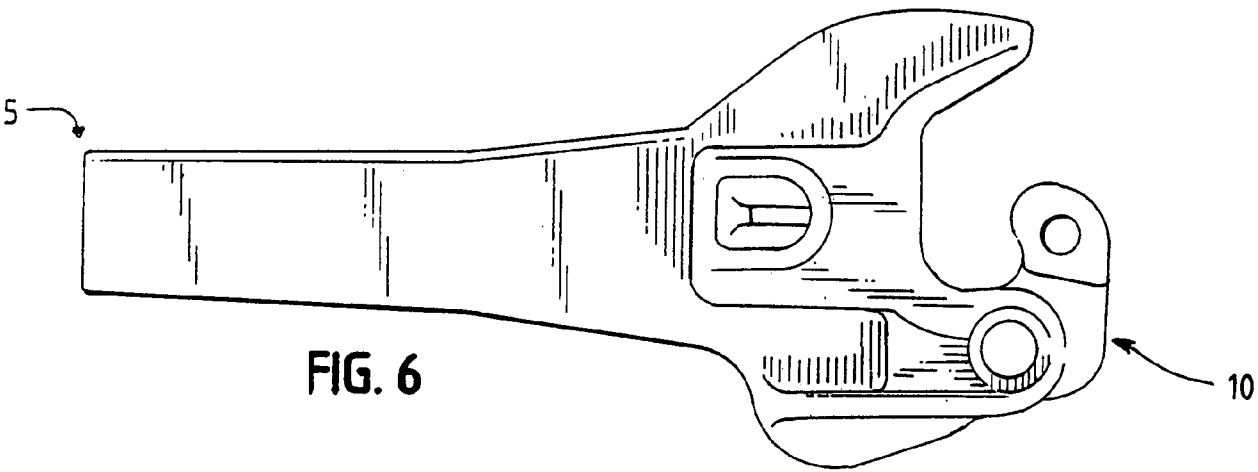
FIG. 6 is a top plan view of the railway car coupler knuckle of FIG. 1 in combination with a coupler.

A coupler knuckle casting 10 is configured for use with a typical coupler 5, as illustrated in FIG. 6, for a railway freight car (not shown). The coupler knuckle casting 10 has an improved or enhanced bearing surface area 12.

The coupler knuckle casting 10 having the enhanced bearing surface area 12 includes a tail section 20, a hub section 30, and a front face section 18, as illustrated in FIGS. 1-5. The hub section 30 has a pivot pin hole 14 formed therein for receiving a pivot pin to pivotably connect the knuckle 10 to the coupler 5. The pivot pin hole 14 may have generally cylindrical sidewalls, and may have a middle region lacking sidewalls. Other portions of the coupler knuckle casting include the buffing shoulder 16, tail stop 21, lower and upper pulling lugs **26*a* and 26*b*, lock wall 36, throat 38 and heel 44, as illustrated in FIGS. 1-5**.

The front face section 18 includes a nose section 22, which may include a generally cylindrical opening 24 formed in an end region of the nose section 22. The opening may be used for supporting a flag pole. A pulling face portion 28 is disposed inwardly from the nose section 22. At least a portion of the pulling face portion 28 includes the enhanced bearing surface area 12, at least a portion of which includes a substantially flat portion 40.

The term substantially flat does not require a perfectly flat surface, as such would not be expected during the casting of coupler knuckles 10. Although preferably flat, the term substantially flat means that there is a lesser degree of taper as compared to the typical degree of taper for sidewalls of a mold cavity for a coupler knuckle casting formed using a typical pattern.

Figure 10:
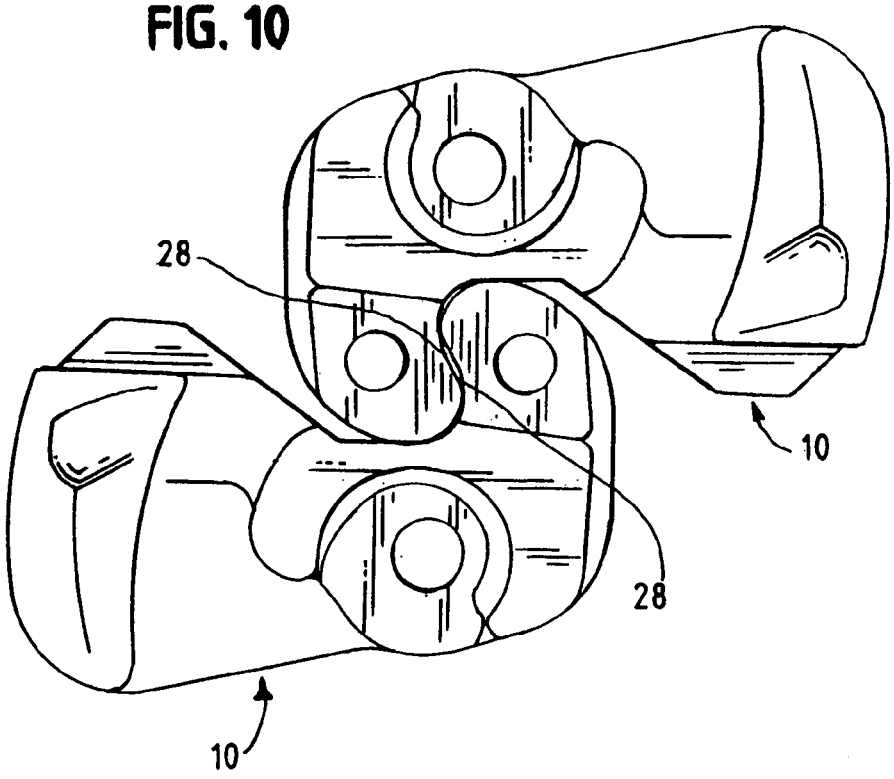
FIG. 10 is a top plan view of a pair of the railway car coupler knuckles of FIG. 1 in draft engagement.

The substantially flat portion 40 is substantially flat in a vertical direction, for example, generally parallel to a central axis of the pivot pin hole 14. The substantially flat portion 40 may be arcuate in a horizontal direction. The substantially flat portion 40 may extends for a predetermined distance in such vertical direction and for a predetermined length along the horizontal direction, for example, generally normal to the central axis of the pivot pin hole 14. The predetermined length of the enhanced bearing surface along the horizontal direction which is arcuate preferably extends over at least a portion of the pulling face portion 28 in the region in which there is pulling engagement between a pair of knuckles in a coupled arrangement, such as illustrated in FIG. 10.

Figure 12:
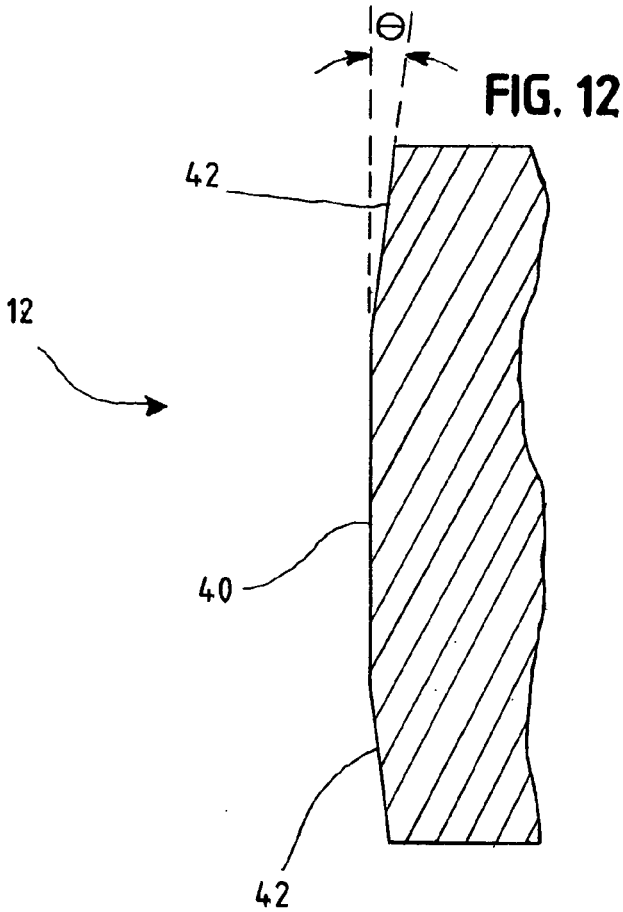
FIG. 12 is a section view taken along line 12-12 of FIG. 11, showing a profile of a portion of the pulling face region having an enhanced bearing surface of the railway car coupler knuckle of FIG. 1.

The enhanced bearing surface 12 may include generally tapered portions 42 adjacent to and on either side of the substantially flat surface, as illustrated in FIG. 12. The tapered portions may be inclined at an acute angle θ relative to a line extending from the substantially vertically flat surface 40. Opposing tapered portions 42 of the enhanced bearing surfaces 12 on a pair of engaged knuckles 10, such as illustrated in FIG. 10, can reduce point to point contact between the knuckles 10. The tapered portions 42 of the enhanced bearing surface 12 are generally each between about 30% and about 70% of the vertical span of the substantially flat surface 40, and are each preferably about 50% of the vertical span of the substantially flat surface 40.

Figure 11:
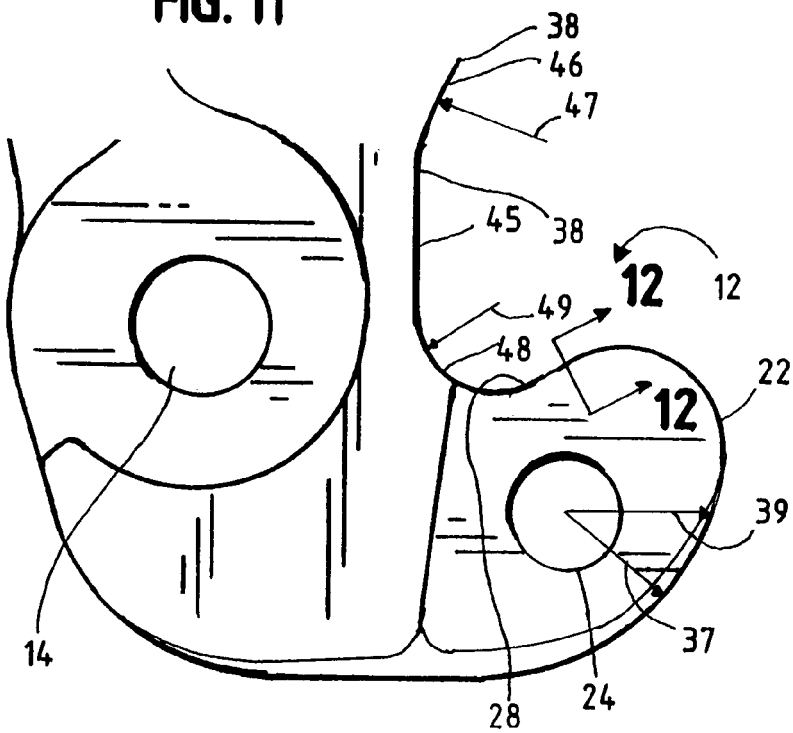
FIG. 11 is an enlarged top plan view of nose, pulling face, and throat regions of the railway car coupler knuckle of FIG. 1.

The enhanced bearing surface 12 is not limited to only those surfaces which bear draft forces when engaged with another knuckle in a pulling arrangement, and is not necessarily limited to the pulling face portion 28. Other regions of the knuckle 10 may have a vertically flat surface 40. For example, the enhanced bearing surface 12 may extend at least partially along the nose 22, pulling face portion 28, and/or throat 38. There are two arcuate portions 46 and 48 of the throat, as illustrated in FIG. 11, that are connected by a generally tangent region 45. Each of these arcuate portions 46 and 48 has a radius 47 and 49. The enhanced bearing surface 12 may extend at one end to the tangent region 45 between the two arcuate portions 46 and 48. At the other end the enhanced bearing surface 12 may extend in the horizontal direction along the nose 22, such as to or along an arcuate region having a radius 39, or even to or along an arcuate region having a radius 37. For example, portions of the nose 22 and throat 38 may have the vertically flat surface 40. An inner side region 34 of the locking wall 36 of the knuckle 10 may have a vertically flat surface. Moreover, the substantially vertically flat surface 40 need not be continuous, but can be in multiple locations.

For the coupler knuckle casting 10 having the enhanced bearing surface area 12, the predetermined distance the substantially flat portion 40 extends in the vertical direction is generally in a range of between about 3.5 inches and about 7.0 inches, and preferably the predetermined distance the substantially flat portion 12 extends in the vertical direction is generally in a range of between about 4.0 inches and about 5.5 inches. In one aspect, the predetermined distance such substantially flat portion 40 extends in the vertical direction is generally in a range of between about 4.0 inches and about 4.5 inches. The enhanced bearing surface area may be hardened to a predetermined hardness, such as about 40 Rockwell C.

The coupler knuckle casting 10 is preferably formed as a steel or other alloy casting. The coupler knuckle casting 10 is produced in a mold cavity 56 within a casting box 50 between cope and drag mold portions 57 and 53. Green sand 54 is used to define the interior boundary walls 52 of the mold cavity 56. The mold cavity 56 is formed using a pattern (not shown). The mold cavity 56 also includes a gating system (not shown) for allowing molten alloy to enter the cavity 56.

Figure 7:
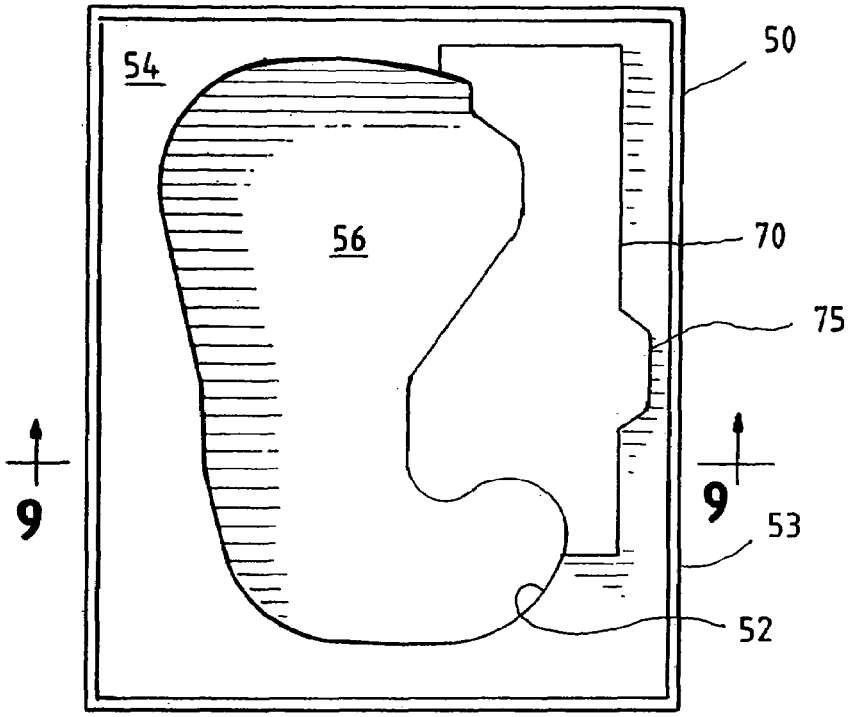
FIG. 7 is a top plan view of a drag portion of a mold for casting the railway car coupler knuckle of FIG. 1 having a combined bearing surface and lock wall core.
Figure 8:
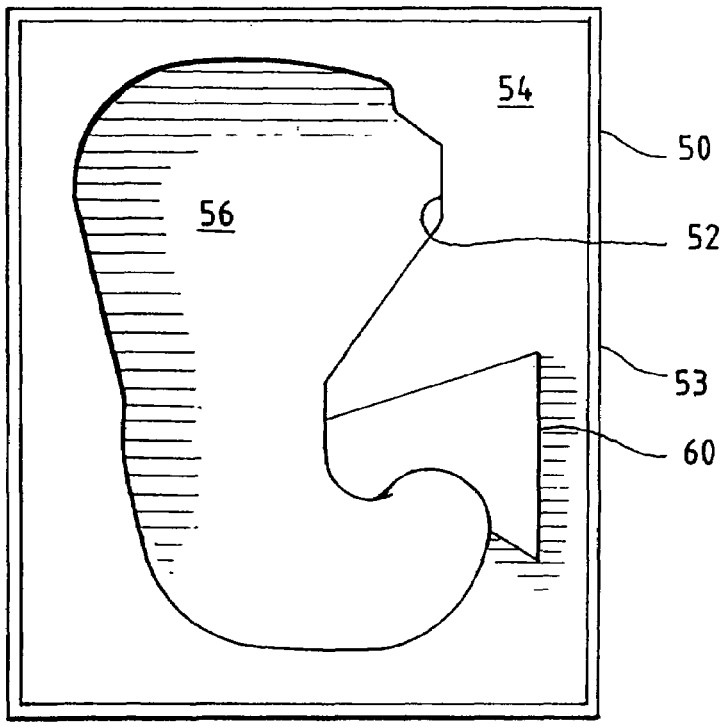
FIG. 8 is a top plan view of a drag portion of a mold for casting the railway car coupler knuckle of FIG. 1 having a bearing surface core.
Figure 9:
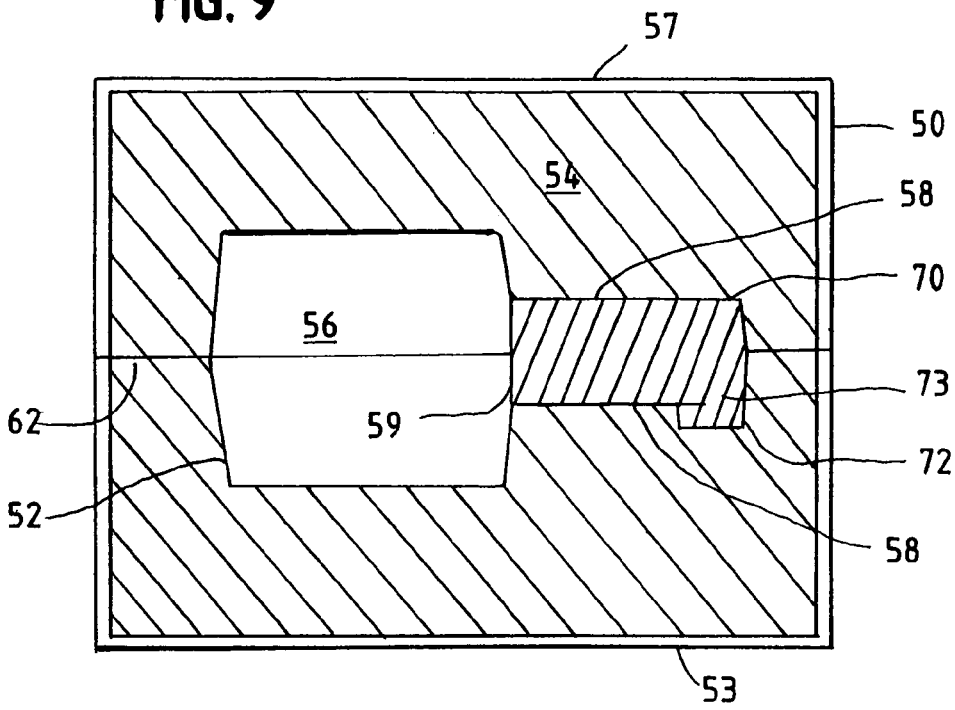
FIG. 9 is a section view taken along line 9-9 of FIG. 7, showing the drag portion along with the addition of a cope portion of the mold for casting the railway car coupler knuckle of FIG. 1 having the extended bearing surface insert.

As discussed above, a pattern typically has draft angles in order to allow for removal of the pattern from the mold cavity 56 without causing excessive deformation of the cavity sidewalls 52. Part of the mold cavity 56 includes a region 58 for receiving a core 60 or 70, as illustrated in FIGS. 7-9. In one aspect, an enlarged core 70 may be provided, and the cavity 56 having a corresponding size for receiving the core 70, as will be discussed in detail greater below. The core 60 is separately manufactured and inserted into the mold cavity 56. The cores 60 and 70 each include a substantially vertical surface 59 that cooperates with the interior walls 52 of the mold cavity 56 to at least partially define the external boundaries of the coupler knuckle casting 10 once cast therein. The use of the core 60 or 70 to define a portion of the coupler knuckle casting 10 allows for the substantially vertical surface 40 to be cast.

The region of the cavity 56 receiving the core 60 or 70 is positioned such that the tapered regions 42 of the coupler knuckle casting 10 can be cast using the taper already created in the sidewalls 52 of the mold cavity 56 due to the draft angles of the pattern. The core 60 or 70 may have a non-rectangular shape, as shown in FIGS. 7 and 8, in order to provide engagement between the sand 54 in the cope and drag mold portions 57 and 53 and the core 60 or 70 to reduce relative movement therebetween during the casting process and to improve their relative positioning. The pattern used in forming the mold cavity 56 may have a core print for forming a depression 72 in the mold cavity 56 for receiving a projection 73 of the core 60 or 70 to assist in accurate placement of the core 60 or 70 relative to one or both of the mold portions 53 and 57. The core 70 also includes projection 75 for a mating with a corresponding depression in the mold cavity for maintaining the position of the core 70 in the mold cavity.

The core 60 may extend only along the pulling face section 28, as illustrated in FIG. 8, to produce a cavity having a perimeter boundary for casting a coupler knuckle 10 having the enhanced bearing surface 12. However, when a larger region of the coupler knuckle casting 10 is desired to have the enhanced bearing surface 12, or even a substantially flat surface 40 or any other surface configuration, one or more cores may be used.

Figure 13:
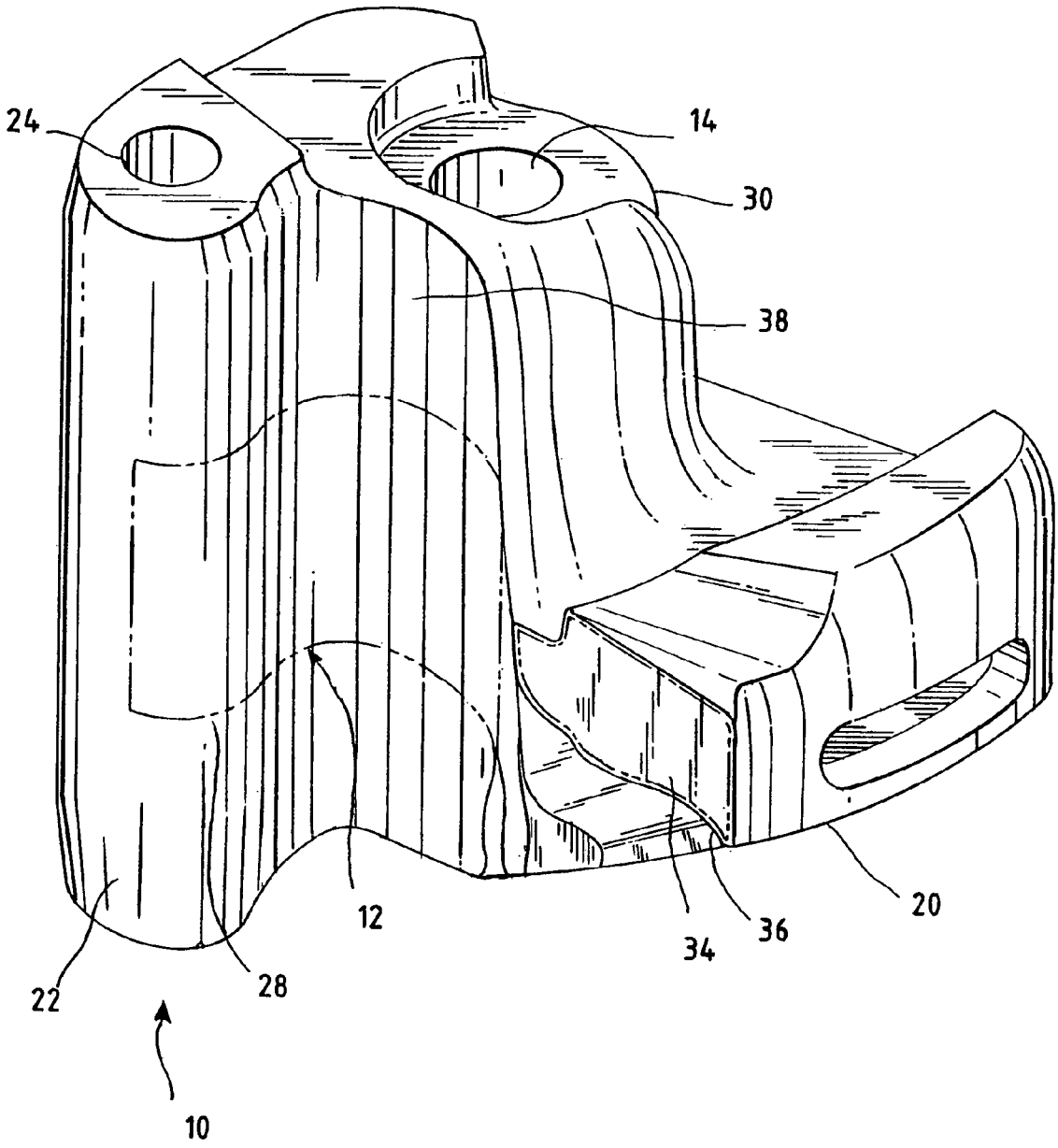
FIG. 13 is a perspective view of a railway car couple knuckle having an enhanced bearing surface and lock wall.
Figure 14:
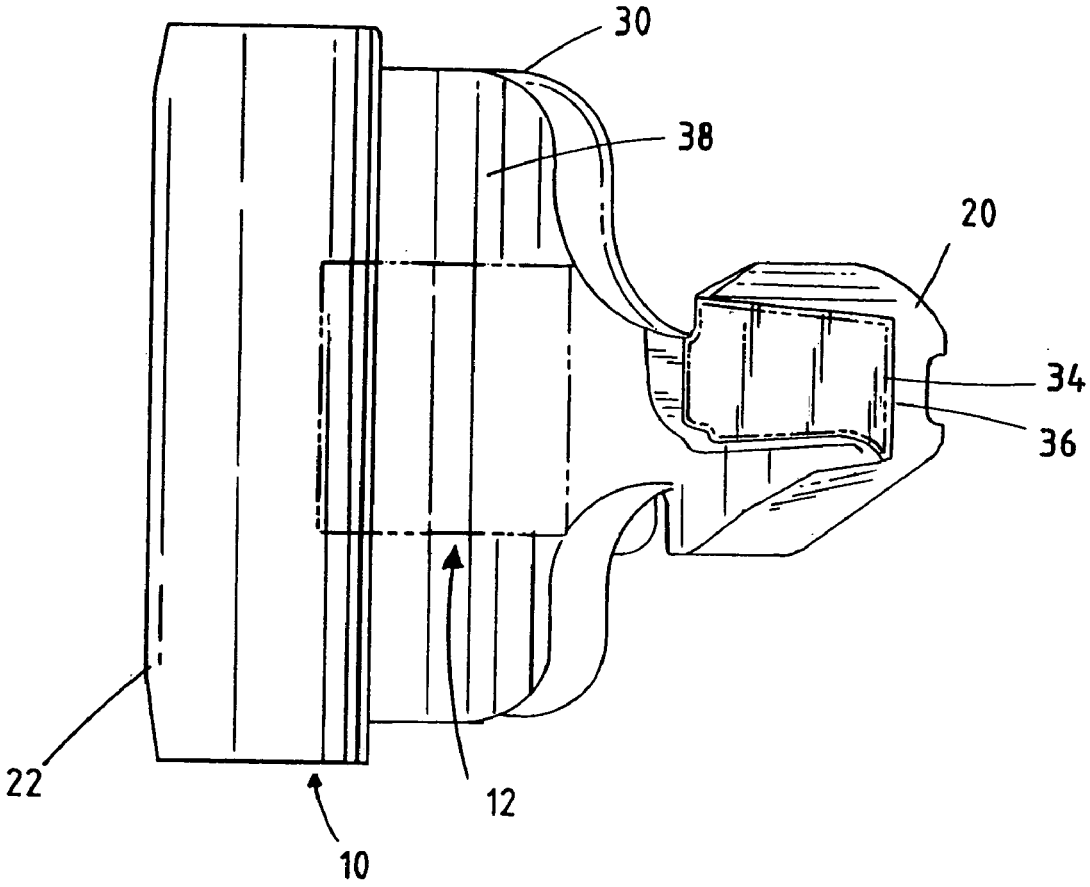
FIG. 14 is a side view of the railway car coupler knuckle of FIG. 13.
Figure 15:
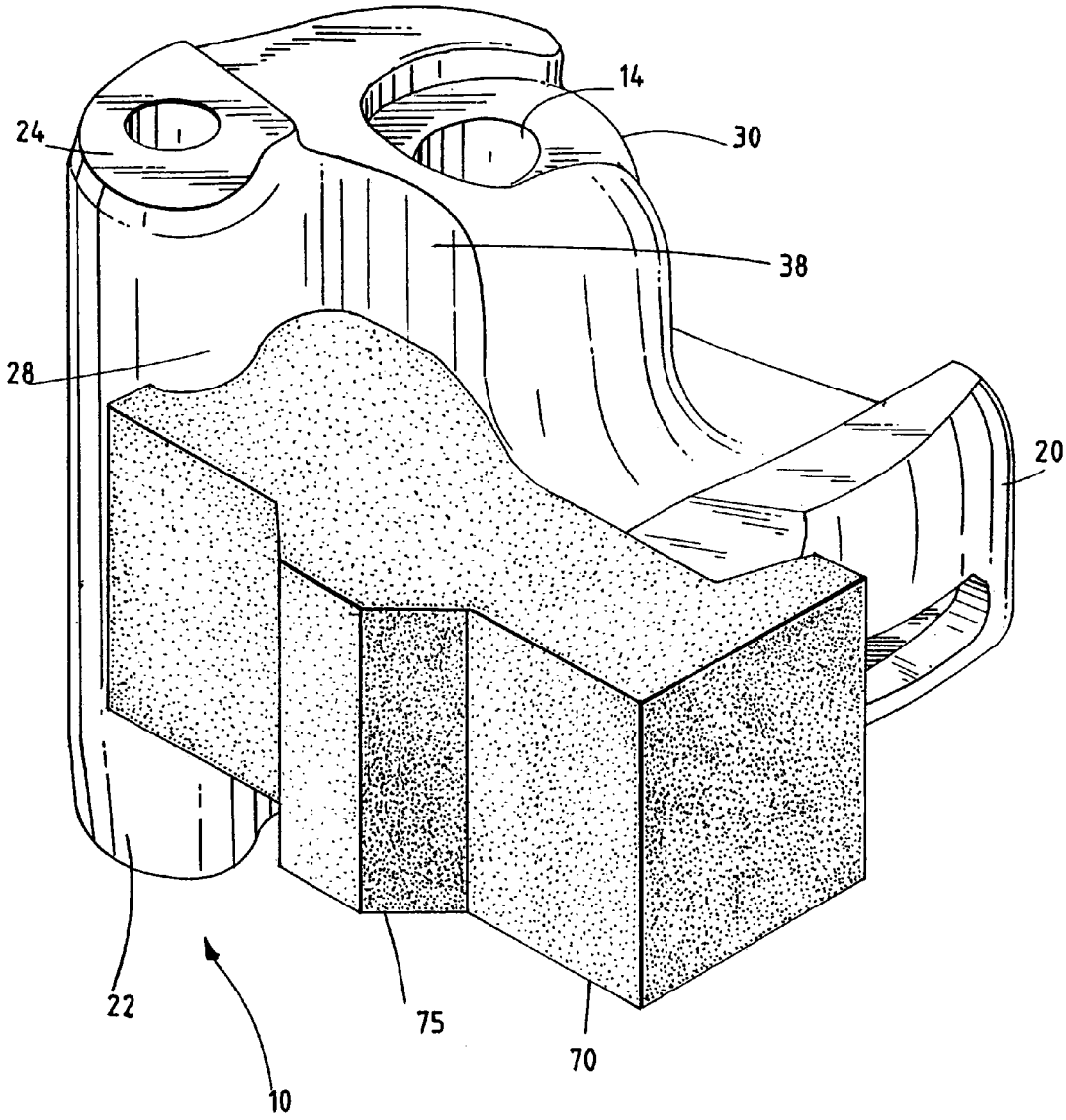
FIG. 15 is a perspective view of the railway car coupler knuckle of FIG. 13 showing a core adjacent the knuckle.
Figure 16:
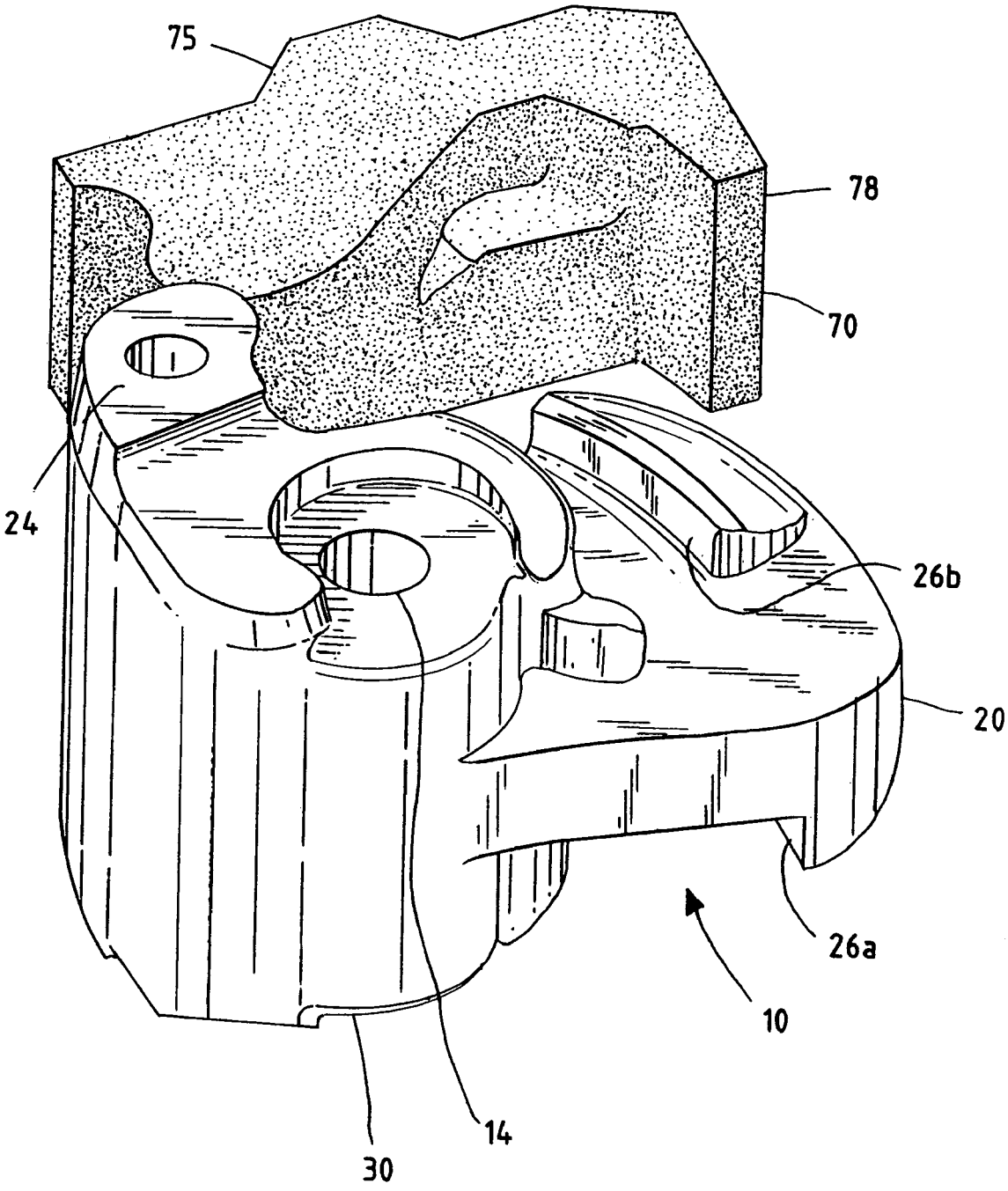
FIGS. 16 and 17 are perspective views of the railway car couple knuckle and core of FIG. 15 showing the core spaced from the knuckle.
Figure 17:
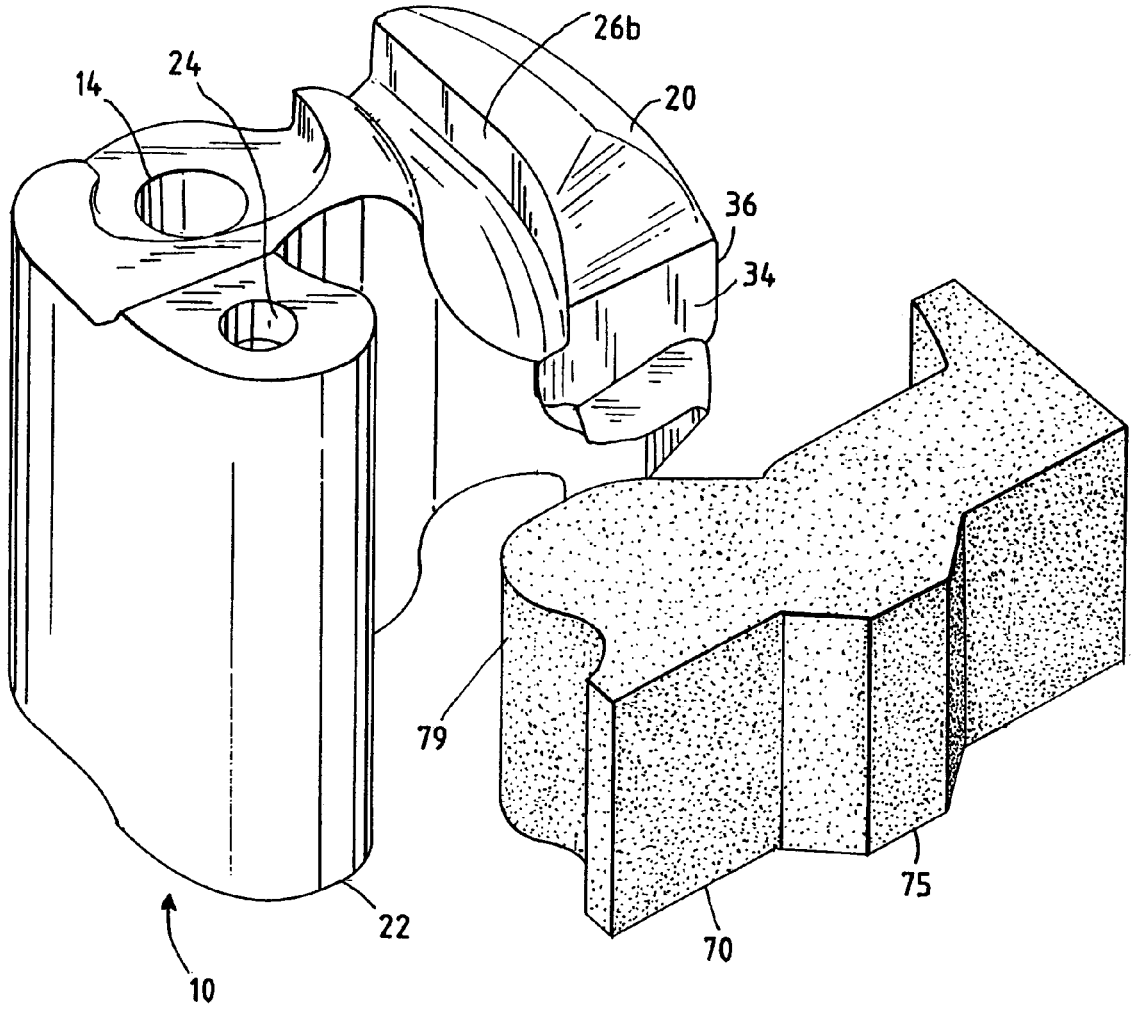

The enlarge core 70 may be used to cast the surfaces which include portions of the nose section 22, the pulling face portion 28, the throat 38 and an inner side portion 34, as illustrated in FIGS. 7 and 15-17. Although not necessary, it is preferable to use a single core for forming the enhanced bearing surface 12 and at least a portion 34 of the lock wall 36, as shown in FIGS. 13 and 14, in order to minimize inaccuracies that can result from imprecise relative positioning of multiple cores. For example, the use of the single core 70 instead of multiple cores to form the bearing surface, whether having the enhanced bearing surface or not, and at least a portion 34 of the lock wall 36 assists in minimizing discrepancies between their ideal relative positions and their actual relative positions when cast. Minimizing such discrepancies improves the interchangeability of knuckles, thereby allowing knuckles cast using different molds or at different times to cooperate in coupling railway cars. The core 70 includes a surface 78 for forming the portion 34 of the lock wall 36 and a surface 79 for forming the bearing surface 12.

Other cores, such as a kidney core, finger core, and pivot pin core, can be placed in the mold cavity 56. Once all of the cores are in place, the cope and drag mold portions 57 and 53 can be brought together and closed along their parting line 62, the cavity can be filled with molten alloy, and the coupler knuckle 10 cast. Once the alloy is solidified, the mold portions 53 and 57 can be separated and the cast coupler knuckle 10 removed.

The present knuckles 10 may be provided in the combination of a railway freight car coupler (not shown) having incorporated therein the coupler knuckle casting 10 having the enhanced bearing surface area 12. The knuckle 10 may also be configured to be suitable for retrofitting an existing railway freight car couplers (not shown).

As will be appreciated, improved knuckle coupler castings and methods for casting the improved knuckle coupler castings are described herein, where the knuckle coupler castings having enhanced bearing surfaces which may include a vertically flat surface. However, the coupler knuckle castings and methods of casting such knuckles are not limited to the preferred embodiments described hereinabove or to any particular embodiments.

What is claimed is:

1. A method of casting a coupler knuckle casting for a railway car coupler, the coupler knuckle casting having an enhanced bearing surface with a substantially flat portion in one direction, the method comprising:

providing a cope mold portion and a drag mold portion, the cope and drag mold portions having internal walls defining at least in part the perimeter boundaries of a mold cavity;

positioning one or more cores in the mold cavity of either the cope or drag mold portion, at least one of the cores having one or more surfaces substantially flat in one direction forming a portion of the perimeter boundaries of the mold cavity for forming at least a portion of the enhanced bearing surface;

closing the cope and drag mold portions with the one or more cores therebetween; and at least partially filling the cavity with a molten alloy, the molten alloy solidifying after filling to form the coupler knuckle casting.

2. A method of casting a coupler knuckle casting in accordance with claim 1, wherein the step of providing the cope mold portion and the drag mold portion includes the step of providing the portions of the walls of the cope and drag mold portions at tapered angles, the tapered angles of the portions of the walls being tapered at an angle relative to the one or more surfaces substantially flat in one direction of the core, the angles being inclined inwardly relative to the cavity and away from the one or more surfaces substantially flat in one direction of the core.

3. A method of casting a coupler knuckle casting in accordance with claim 2, wherein the ratio between one of the portions of the walls of the cope and drag mold portions having tapered angles and the one or more surfaces substantially flat in one direction of the core is between about 3:10 and 7:10.

4. A method of casting a coupler knuckle casting in accordance with claim 3, wherein the ratio between one of the portions of the walls of the cope and drag mold portions having tapered angles and the one or more surfaces substantially flat in one direction of the core is about 1:2.

5. A method of casting a coupler knuckle casting in accordance with claim 1, wherein the enhanced bearing surface is positioned on at least a portion of the pulling face portion of the coupler knuckle casting.

6. A method of casting a coupler knuckle casting in accordance with claim 5, wherein the enhanced bearing surface is positioned on at least a portion of a nose section of the coupler knuckle casting.

7. A method of casting a coupler knuckle casting in accordance with claim 5, wherein the enhanced bearing surface is positioned on at least a portion of a throat of the coupler knuckle casting.

8. A method of casting a coupler knuckle casting in accordance with claim 5, wherein the enhanced bearing surface is positioned on at least a portion of the pulling face portion and the throat of the coupler knuckle casting, the portion of the enhanced bearing surface extending from the enhanced bearing surface to a tangent surface between two radii of the throat.

9. A method of casting a coupler knuckle casting in accordance with claim 1, wherein the enhanced bearing surface is positioned on at least a portion of the inner side region of the locking face of the coupler knuckle casting.

10. A method of casting a coupler knuckle casting in accordance with claim 9, wherein the enhanced bearing surface is positioned on at least a portion of the pulling face portion of the coupler knuckle casting.

11. A method of casting a coupler knuckle casting in accordance with claim 10, including the step of using the core to form the enhanced bearing surfaces on the pulling face portion and inner side region of the locking face of the coupler knuckle casting.

* * * * *